US005409325A

United States Patent [19]

Wu

[11] Patent Number: 5,409,325

[45] Date of Patent: Apr. 25, 1995

[54] VINYL WALKWAY PAVER

[76] Inventor: Ming-Hsin Wu, 20, Lane 92, Shing Ell Street, Tao Yuan City, Tao Yuan County, Taiwan, Prov. of China

[21] Appl. No.: 194,586

[22] Filed: Feb. 10, 1994

[51] Int. Cl.[6] ..... E01C 5/20

[52] U.S. Cl. ..... 404/34; 404/41; 404/45; 52/596; 52/604

[58] Field of Search ..... 404/34, 35, 40, 41, 404/42, 44, 45; 52/589.1, 591.1, 591.3, 592.1, 592.2, 606, 604, 605

[56] References Cited

U.S. PATENT DOCUMENTS 4,826,351 5/1989 Haberhauer et al. ..... 404/35
5,186,703 2/1993 Huang ..... 482/148

FOREIGN PATENT DOCUMENTS 833232 7/1932 Australia .
3435909 4/1986 Germany .

*Primary Examiner*—Ramon S. Britts
*Assistant Examiner*—Pamela Anne O'Connor
*Attorney, Agent, or Firm*—Bacon & Thomas

[57] ABSTRACT

A vinyl walkway paver, particularly the one used as a paving stone with grass contained therein. The paver can be integrally formed to have a surface with a plurality of ridged bodies which are different in sizes. The center of the paver is a recessed portion, the four sides of the recessed portion form a hollow frame, the corners joining the diagonals of the frame are provided with corner holes and corner blocks. By such configuration, a plurality of pavers can be laid on the walkway, the central recessed portion thereof can be filled up with soil for planting grass. Moreover, the interior wall of the hollow frame can be provided with a plurality of ribs to form a suitable rough surface for strengthening the structure of the paver. Expansible materials such as polystyrene can also be filled inside the frame to give a better bonding structure.

4 Claims, 5 Drawing Sheets

VINYL WALKWAY PAVER

BACKGROUND OF THE INVENTION (a) Field of the Invention

The present invention relates to a design structure for a vinyl walkway paver, particularly to a hollow paver which can be easily laid on a surface to form a decorative walkway that people can walk on for a healthy body.

(b) Description of the Prior Art

A conventional walkway can be formed by pouring cement or laying brick on top of a roadway. It is also popular nowadays to use pebbles on the surface of the walkway because they can provide massaging effects on the bare foot. The massaging effects stimulate the blood circulation which is important for a healthy body. However, it takes a long time and is expensive to build a walkway with pebbles on the surface. In addition, the paving of the conventional walkway has to be carried out by a professional team. Because of these above limitations, the use of the conventional walkway for healthy walking exercise is restricted.

SUMMARY OF THE INVENTION

It is a main object of the invention to provide a structure for a vinyl paver which can be molded integrally with a hollow body. The diagonal corners of the paver are provided with corner holes and matching corner blocks so that the pavers can be laid and set together. A central recessed portion in the paver is provided for grass to grow. The inside of the hollow frame can be filled up with suitable filler materials, and the surface of the paver can be provided with ridged bodies. When a bare foot is in contact with the ridged bodies, a massaging effect is induced which promotes the health of the walker. The construction of the walkway using the present invention is simple and economical.

It is another object of the invention to provide a structure of a vinyl paver which can be set and laid on the pavement by any user, eliminating the need for professional construction personnel. This promotes the popularity of the invention and gives an alternative choice for gardening decoration.

It is yet another object of the invention to provide a structure for a vinyl paver which can be formed integrally with plastics. Therefore, different colors of pavers can be made available for the consumers to choose from. The pavers can be used to form a colorful walkway to beautify the view of gardening.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
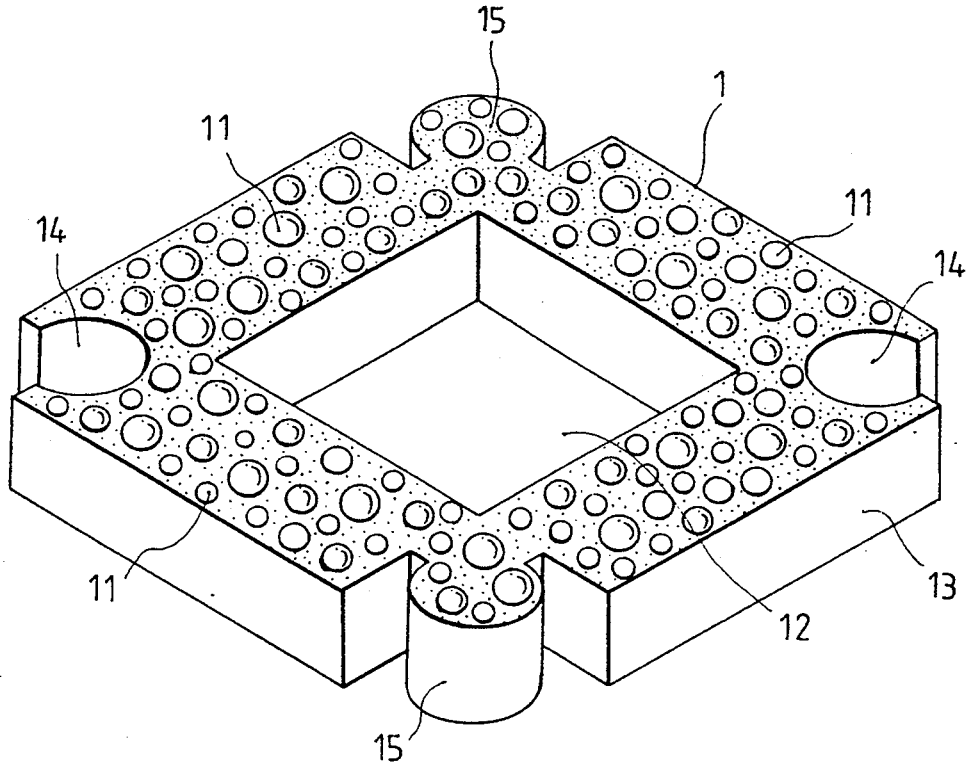
FIG. 1 is a perspective view of the vinyl paver according to the present invention.
Figure 2:
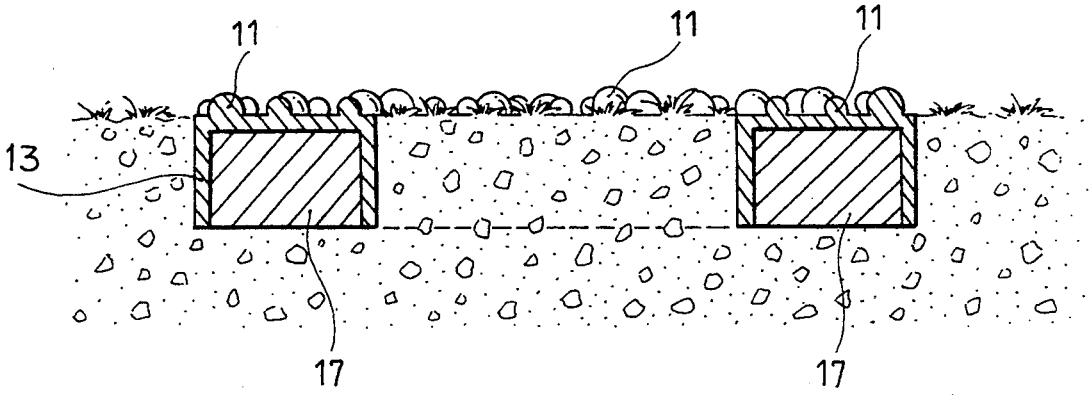
FIG. 2 is a sectional diagrammatic view of the vinyl paver according to the present invention.
Figure 3:
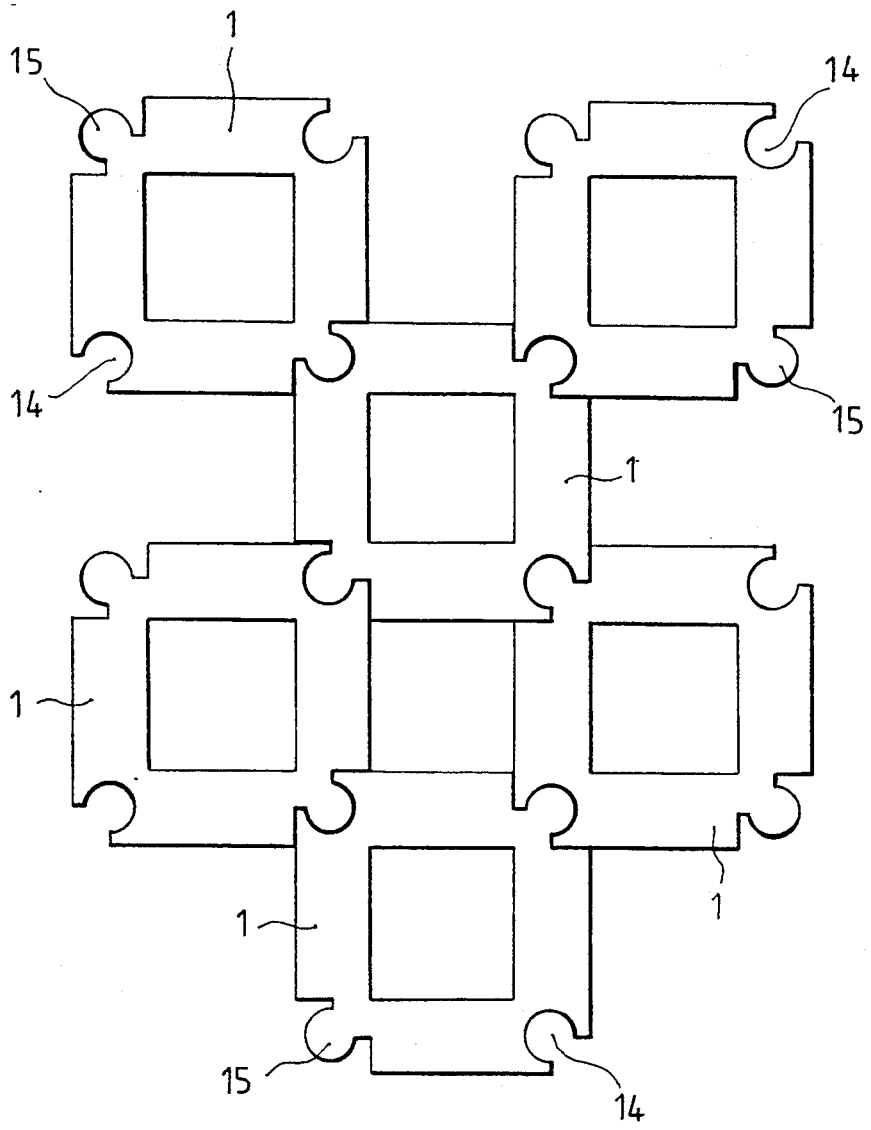
FIG. 3 is a diagrammatic view of an embodiment of the present invention forming a paving on a walkway.

As shown in the drawings, the vinyl walkway paver (1) according to the present invention can be molded integrally from plastics. The surface of the vinyl walkway paver has a plurality of ridged bodies (11) which are formed in various sizes. The center of the paver is a recessed open portion (12), the four sides of which form into a hollow frame (13). The corners joining the diagonals of the frame (13) are provided with corner holes (14) and corner blocks (15). The corner holes (14) are cut out from the paver (1) and the corner blocks (15) are provided to match the size of the corner holes (14). By such configuration, a plurality of pavers (1) can be set together on the surface of a walkway, as is shown in FIG. 3. In the illustration, the recessed portion (12) in the center of each of the paver (1) can be filled with soil so that a piece of lawn can be grown therein, forming a walkway with the beauty of green grass for a healthy walking exercise. When a pedestrian takes a walk on the walkway on his bare foot, the ridged bodies (11) of the vinyl paver (1) come in contact with the bottom of the bare foot, providing a massaging effect to promote the circulation of the blood in the human body.

The shape of the vinyl paver (1) basically does not have to be restricted as long as each individual paver can be aligned with the adjacent pavers during the installation. The vinyl pavers (1) used in the embodiment have substantially rectangular shapes for ease of illustration. Similarly, there is no restriction on the shapes of the corner holes (14) and the corner blocks (15) provided in the corners of the pavers (1) as long as the corner blocks can be adapted into the corner holes. Moreover, the shapes of the central recessed portion (12) of the pavers (1) can be molded to have circular, multiple-angled, flower-pattern, star shapes or even the shape of a cartoon character. All these simple variations and modifications of the embodiment can be made, and it is intended to cover in the appended claims all such modifications that fall within the scope of the invention.

Figure 4:
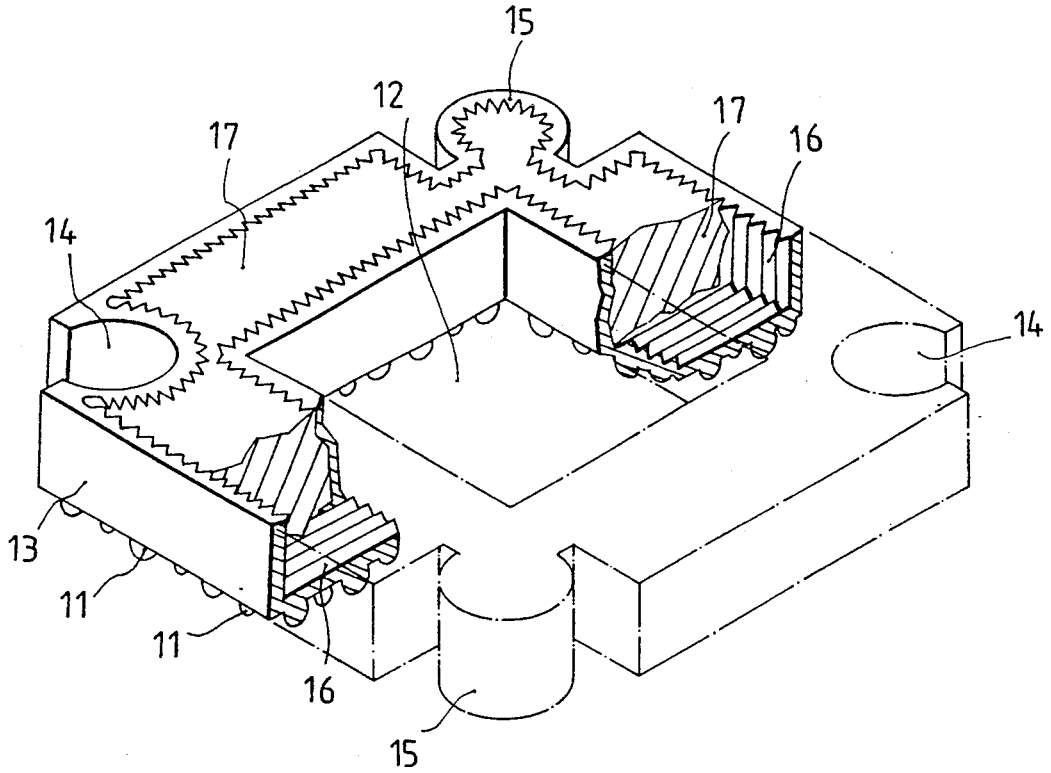
FIG. 4 is a perspective view partly in section of the vinyl paver according to the present invention

In addition, the hollow frame (13) of the present invention can be provided, in its interior wall, with a plurality of ribs or any other forms to make a rough surface (16), as is shown in FIG. 4. The formation of the rib-shaped rough surface (16) strengthen the structure of the vinyl paver so that the latter can be used for a long period of time without any deformation. Moreover, the inside of the hollow frame (13) of the vinyl paver (1) can also be filled up appropriately with a filler material (17) such as expansible polystyrene, so as to prevent the main body from deformation due to the walking thereon. The rib-shaped rough surface (16) also provides the fill-in material (17) with a better bonding inside the hollow frame (13).

The vinyl paver (1) can also be integrally formed to have different colors, so that a user can have more selection to choose from. The colorful pavers can be used for decoration to provide a live garden. The paver (1) according to the present invention is a relatively new design.

Figure 5:
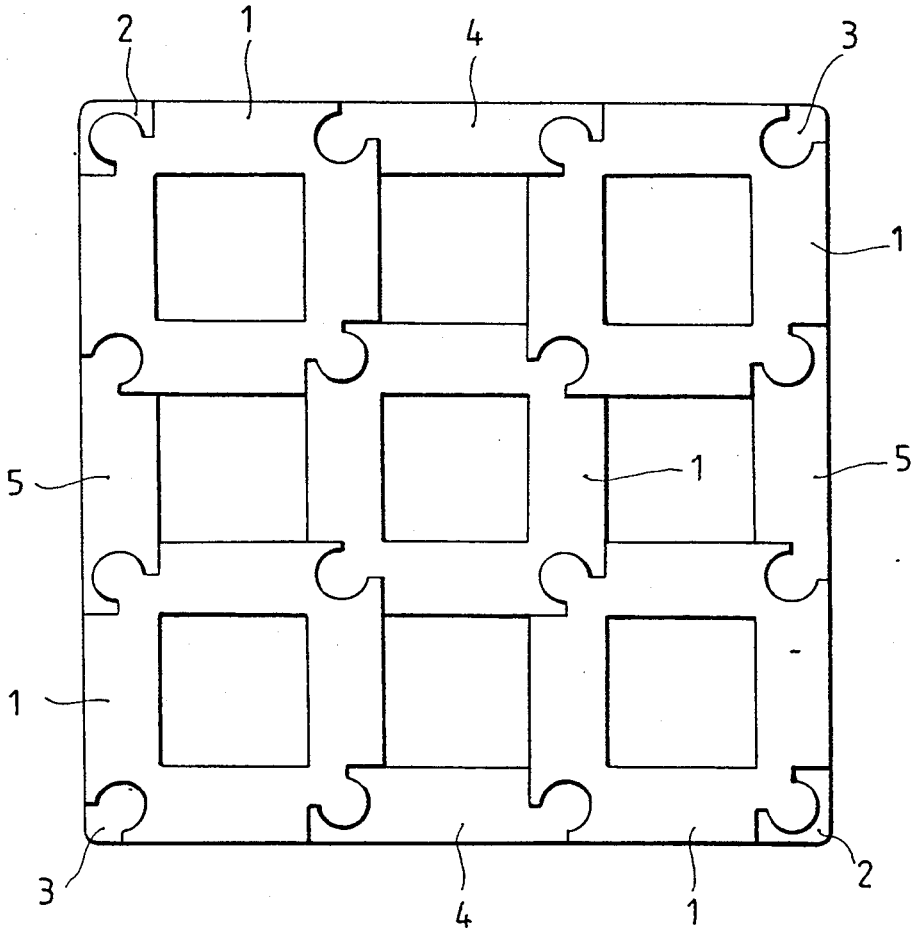
FIG. 5 shows an embodiment of a walkway formed by vinyl pavers according to the present invention, with edge accessories used in the embodiment to provide a finished look to the walkway.

In order to integrate the pavers (1) together to a perfectly aligned and matched walkway, the present invention can be provided with accessories to match the edges of the walkway. As is shown in FIG. 5, when the vinyl pavers (1) are laid on the walkway, the edges and corners are left with gaps or openings, which can be filled in with accessories (2), (3), (4) and (5). Each of these accessories has a specific shape designed for a specific openings so as to provide a complete vinyl walkway.

What is claimed is:

1. A walkway paver comprising:

a) a plurality of elongate sides joined together at opposite ends thereof and forming a polygonal-shaped frame having an open center portion and plural pairs of corner portions, with each pair of corner portions being diagonally opposed from each other along a diagonal of the polygon;

b) at least one pair of corner portions defining a pair of blocks and at least one pair of corner portions defining a pair of holes, each block and each hole having corresponding configurations for permitting plural pavers to be joined together to form a walkway by selectively engaging the blocks within the holes of adjacent pavers; and c) the frame including a top wall having an upper surface provided with a plurality of ridged bodies for massaging the bottom of a foot walking thereon and a plurality of sidewalls, the top and side walls collectively defining an open bottom cavity, and the cavity including an interior wall surface having a roughened configuration for imparting structural strength to the paver.

2. The walkway paver of claim 1 wherein the roughened configuration of the interior wall surface is ribbed-shaped.

3. The walkway paver of claim 1 or 2 wherein the cavity is filled with a filler material for preventing deformation of the paver due to walking thereon.

4. The walkway paver of claim 3 wherein the filler material includes expansible polystyrene.

* * * * *